US011085602B2

(12) United States Patent
Van Bommel et al.

(10) Patent No.: US 11,085,602 B2
(45) Date of Patent: Aug. 10, 2021

(54) LED FILAMENT LAMP OF CANDLE LIGHT APPEARANCE

(71) Applicant: SIGNIFY HOLDING B.V., Eindhoven (NL)

(72) Inventors: Ties Van Bommel, Horst (NL); Rifat Ata Mustafa Hikmet, Eindhoven (NL); Robert Jacob Pet, Waalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/045,147

(22) PCT Filed: Apr. 9, 2019

(86) PCT No.: PCT/EP2019/058933
§ 371 (c)(1),
(2) Date: Oct. 2, 2020

(87) PCT Pub. No.: WO2019/197394
PCT Pub. Date: Oct. 17, 2019

(65) Prior Publication Data

US 2021/0148533 A1 May 20, 2021

(30) Foreign Application Priority Data

Apr. 11, 2018 (EP) ..... 18166748

(51) Int. Cl.
*F21S 10/04* (2006.01)
*H05B 45/20* (2020.01)
(Continued)

(52) U.S. Cl.
CPC ..... *F21S 10/04* (2013.01); *F21K 9/232* (2016.08); *H05B 45/20* (2020.01); *F21Y 2115/10* (2016.08)

(58) Field of Classification Search
CPC ..... F21S 10/04; H05B 45/20; F21K 9/232; F21K 9/60; F21Y 2115/10; F21Y 2103/10; F21V 9/40; F21V 9/45
(Continued)

(56) References Cited

U.S. PATENT DOCUMENTS 8,933,478 B2 * 1/2015 Tischler ..... H01L 33/504 257/98
10,854,800 B2 * 12/2020 Wang ..... F21K 9/232
(Continued)

FOREIGN PATENT DOCUMENTS

CN 106678730 A 5/2017
EP 2535640 A1 12/2012
(Continued)

*Primary Examiner* — Peggy A Neils
(74) *Attorney, Agent, or Firm* — Daniel J. Piotrowski

(57) ABSTRACT

A light emitting diode, LED, filament lamp (100), comprising at least one filament (120, 120*a*, 120*b*) extending over a length, L, along a longitudinal axis, A, wherein the LED filament comprises an array of a plurality of LEDs (140) extending along the longitudinal axis, and an encapsulant (145) at least partially enclosing the plurality of LEDs, wherein the encapsulant comprises a luminescent material (150), and wherein at least one of the thickness, TL, of the encapsulant along a transverse axis, B, perpendicular to the longitudinal axis, and the concentration, CL, of the luminescent material in the encapsulant, varies over at least a portion of the length, L, of the at least one filament along the longitudinal axis, whereby the color temperature, CTL, of the light emitted from the at least one LED filament varies over the length of the at least one LED filament at least along the portion thereof.

14 Claims, 6 Drawing Sheets

(51) Int. Cl.
*F21K 9/232* (2016.01)
*F21Y 115/10* (2016.01)

(58) Field of Classification Search
USPC ..... 362/84, 392
See application file for complete search history.

(56) References Cited

U.S. PATENT DOCUMENTS

| | | | | |
|---|---|---|---|---|
| 2009/0001869 | A1 | 1/2009 | Tanimoto et al. | |
| 2009/0251882 | A1* | 10/2009 | Ratcliffe ..... | F21K 9/232 362/84 |
| 2010/0301370 | A1 | 12/2010 | Wu et al. | |
| 2011/0305002 | A1 | 12/2011 | Lim et al. | |
| 2012/0051075 | A1 | 3/2012 | Harada et al. | |
| 2017/0241598 | A1 | 8/2017 | Jiang et al. | |

FOREIGN PATENT DOCUMENTS

| | | | |
|---|---|---|---|
| JP | 5960565 | B2 | 8/2016 |
| WO | 2017162530 | A1 | 9/2017 |

* cited by examiner

LED FILAMENT LAMP OF CANDLE LIGHT APPEARANCE

CROSS-REFERENCE TO PRIOR APPLICATIONS

This application is the U.S. National Phase application under 35 U.S.C. § 371 of International Application No. PCT/EP2019/058933, filed on Apr. 9, 2019, which claims the benefit of United European Patent Application No. 18166748.6, filed on Apr. 11, 2018. These applications are hereby incorporated by reference herein.

FIELD OF THE INVENTION

The present invention generally relates to lighting arrangements comprising one or more light emitting diodes. More specifically, the lighting arrangement is related to a light emitting diode (LED) filament lamp configured to provide an appearance of a candle light during operation of the LED filament lamp.

BACKGROUND OF THE INVENTION

The use of light emitting diodes (LED) for illumination purposes continues to attract attention. Compared to incandescent lamps, fluorescent lamps, neon tube lamps, etc., LEDs provide numerous advantages such as a longer operational life, a reduced power consumption, and an increased efficiency related to the ratio between light energy and heat energy. However, the light generated by LED lamps as well as incandescent lamps may, for some applications, appear static, "cold" and/or unattractive.

Candles, on the other hand, are able to generate light which is highly attractive and appealing. Light emitted from the open flame of a candle may, compared to light emitted from LEDs and/or incandescent lamps, appear more vivid, "warm", aesthetic and/or romantic. However, one of the major disadvantages of the use of candles is the risk of fire associated with an open flame.

Hence, it is an object of the present invention to try to overcome the respective disadvantages of candles, on the one hand, and light emitted from LEDs, on the other hand, by exploring the possibility of combing one or more of the respective advantages of candle light and LED lighting devices.

In CN 106678730 a filament is disclosed with two parallel positioned arrays of LEDs that can be individually controlled. The two arrays of LEDs are of different color and therewith the color temperature of the filament can be controlled.

SUMMARY OF THE INVENTION

Hence, it is of interest to explore the possibility of combining one or more of the numerous advantages of LED lighting devices with the attractiveness and the appealing properties of light emitted from a candle.

This and other objects are achieved by providing a LED filament lamp having the features in the independent claim. Preferred embodiments are defined in the dependent claims.

Hence, according to the present invention, there is provided a LED filament lamp. The LED filament lamp comprises at least one LED filament extending over a length along a longitudinal axis. The LED filament comprises an array of a plurality of light emitting diodes, LEDs, extending along the longitudinal axis. The LED filament further comprises an encapsulant at least partially enclosing the plurality of LEDs, wherein the encapsulant comprises a luminescent material. At least one of the thickness of the encapsulant along a transverse axis perpendicular to the longitudinal axis, and the concentration of the luminescent material in the encapsulant, varies over at least a portion of the length of the at least one LED filament along the longitudinal axis. Consequently, the color temperature of the light emitted from the at least one LED filament varies over the length of the at least one LED filament least along a portion thereof.

Thus, the present invention is based on the idea of providing a LED filament lamp wherein the appearance of the LED filament(s) of the LED filament lamp and/or the light emitted from the LED filament lamp during its operation may resemble or mimic that of a candle. Furthermore, by the features of the LED filament lamp, the lamp is furthermore able to combine one or more of the numerous advantages of LED lighting devices with the attractiveness and the appealing properties of light emitted from a candle.

The present invention is advantageous in that properties of the LED filament(s) of the LED filament lamp may lead to a generation of light which may resemble or mimic the relatively vivid, "warm", aesthetic and/or romantic light of an open flame of a candle.

The present invention is further advantageous in that the LED filament lamp may combine the aesthetic features of candle light with the incontestable safety of operating an electric light compared to that of a light source having an open flame.

The present invention is further advantageous in that the LED filament lamp has a much longer operational life compared to that of a candle. Hence, it is much more convenient and/or cost-efficient to operate a LED filament lamp instead of a candle.

It will be appreciated that the LED filament lamp of the present invention furthermore comprises relatively few components. The low number of components is advantageous in that the LED filament lamp is relatively inexpensive to fabricate. Moreover, the low number of components of the LED filament lamp implies an easier recycling, especially compared to devices or arrangements comprising a relatively high number of components which impede an easy disassembling and/or recycling operation.

The LED filament lamp comprises at least one LED filament. The at least one LED filament, in its turn, comprises an array of LEDs. By the term "array", it is here meant a linear arrangement or chain of LEDs, or the like, arranged on the LED filament(s). The LEDs may furthermore be arranged, mounted and/or mechanically coupled on/to a substrate of each LED filament, wherein the substrate is configured to support the LEDs. The LED filament(s) further comprises an encapsulant at least partially enclosing the plurality of LEDs. By the term "encapsulant", it is here meant a material, element, arrangement, or the like, which is configured or arranged to at least partially surround, encapsulate and/or enclose the plurality of LEDs of the LED filament(s). The encapsulant comprises a luminescent material. By the term "luminescent material", it is here meant a material, composition and/or substance which is configured to emit light under external energy excitation. For example, the luminescent material may comprise a fluorescent material. The thickness of the encapsulant along a transverse axis perpendicular to the longitudinal axis and/or the concentration of the luminescent material in the encapsulant varies over at least a portion of the length of the LED filament(s) along the longitudinal axis. As a result, the color temperature of the light emitted from the LED filament(s) varies over the length of the LED filament(s) at least along the portion thereof.

According to an embodiment of the present invention, at least one of the thickness of the encapsulant and the concentration of the luminescent material in the encapsulant may increase at least along a portion of the at least one LED filament from a base portion to a top portion of the at least one LED filament. Consequently, the color temperature of the light emitted from the at least one LED filament may decrease in a direction from the base portion to the top portion at least along the portion of the LED filament. The present embodiment is advantageous in that the decrease of the color temperature of the light emitted from the LED filament(s) may resemble that of a candle light.

According to an embodiment of the present invention, at least one of the thickness of the encapsulant and the concentration of the luminescent material in the encapsulant may increase non-linearly. It will be appreciated that the non-linear increase of the thickness of the encapsulant and/or the concentration of the luminescent material in the encapsulant may lead to a non-linear variation of the color temperature of the light emitted from the LED filament(s). The present embodiment is advantageous in that a non-linear variation of the color temperature of the light emitted from the LED filament(s) may, to an even further extent, resemble or mimic the light of an (open flame) candle.

According to an embodiment of the present invention, a first section of the at least one LED filament is defined between a base portion and an intermediate portion of the at least one LED filament. A second section of the at least one LED filament is defined between the intermediate portion and a top portion of the at least one LED filament. At least one of the thickness of the encapsulant and the concentration of the luminescent material in the encapsulant may increase along the first section and may remain constant along the second section. Consequently, the color temperature of the light emitted from the at least one LED filament may decrease along the first section in a direction from the base portion to the intermediate portion, and may remain constant along the second section. Hence, the light emitted from the LED filament(s) has a relatively high color temperature, although decreasing, between the base portion and the intermediate portion of the LED filament(s). In relation, the light emitted from the LED filament(s) has a lower, constant color temperature between the intermediate portion and the top portion of the LED filament(s). The present embodiment is advantageous in that the LED filament(s) hereby may, to an even further extent, mimic or resemble the light emitted from an open flame.

According to an embodiment of the present invention, the first section of the at least one LED filament may be shorter than the second section of the at least one LED filament. It will be appreciated that the LED filament(s) may mimic the appearance and/or properties of a wick of a candle. The present embodiment is advantageous in that the configuration may even further contribute to the generation of light from the LED filament lamp which may resemble that of candle light.

According to an embodiment of the present invention, the LED filament lamp may further comprise a diffusor element. The diffusor element may at least partially enclose the at least one filament and be arranged to diffuse the light emitted from the at least one filament. By the term "diffusor element", it is here meant a diffusing layer and/or an element which possesses properties for diffusing light. For example, the "diffusor element" may be a light guide which is translucent e.g. by surface roughness or scattering.

The present embodiment is advantageous in that the diffusor element may contribute to an emission of light from the LED filament lamp which, to an even further extent, may resemble that of a candle.

According to an embodiment of the present invention, the LED filament lamp may further comprise a control unit coupled to the at least one LED filament and be configured to control the power supply of the at least one LED filament. By the term "control unit" it is hereby meant a device, arrangement, element, or the like, which is configured to control the power supply to the LED filament(s). It will be appreciated that the control of the control unit furthermore may be performed according to one or more predetermined settings. By the term "predetermined setting", it is hereby meant a setting, setup, program, relationship, or the like, which is set or determined in advance. The control unit may hereby control the power supply, and consequently, the color temperature of the light emitted from the LED filament(s) as a function of this or these predetermined setting(s).

According to an embodiment of the present invention, the control unit may be configured to individually control an operation of each LED of the plurality of LEDs.

According to an embodiment of the present invention, the LED filament lamp may comprise at least two LED filaments, wherein the control unit may be configured to individually control the power supply to the at least two LED filaments and to individually control the operation of each LED of the plurality of LEDs of each LED filament. The present embodiment is advantageous in that the control unit may operate the power supply to the LED filaments and control the operation of each LED such that an even more "vivid" light is emitted from the LED filaments, which may resemble light from an open flame candle.

According to an embodiment of the present invention, the LED filament lamp may comprise at least two LED filaments arranged in parallel along the longitudinal axis. The present embodiment is advantageous in that the present arrangement of LED filaments may, to an even further extent, lead to an emission of light from the LED filaments which may have appearance and the aesthetically appealing properties of candle light.

According to an embodiment of the present invention, the LED filament lamp may comprise three LED filaments arranged in parallel along the longitudinal axis. The three LED filaments may further be grouped such that in a cross-section, parallel to the transverse axis, each LED filament is arranged on a respective corner of a triangle.

According to an embodiment of the present invention, the LED filament lamp may comprise at least two LED filaments, wherein the lengths of at least two of the at least two LED filaments may differ from each other. The present embodiment is advantageous in that the arrangement of LED filaments as exemplified may lead to an emission of light from the LED filaments which may resemble candle light.

According to an embodiment of the present invention, the LED filament lamp may comprise at least two LED filaments, wherein at least two of the at least two LED filaments may be shifted with respect to each other along the longitudinal axis. In other words, the plurality of LED filaments, arranged in a parallel, may be shifted with respect to each other.

According to an embodiment of the present invention, the LED filament lamp may comprise at least two LED filaments. The color temperature of the light emitted from the at least one first LED filament may differ, at least along a portion thereof along the longitudinal axis, from the color temperature of the light emitted from the at least one second LED filament. The present embodiment is advantageous in that the ability of the LED filament lamp to vary the color temperature with respect to different LED filaments may contribute to the appearance and the aesthetically appealing properties of candle light.

According to an embodiment of the present invention, the color temperature of the light emitted from the at least one LED filament may vary along the length of the at least one LED filament in the range of 5000 K to 1500 K, more preferably 4000 K to 1700 K, and most preferred 2700 K to 1900 K. In combination herewith, or according to another embodiment of the present invention, the color rendering index of the light emitted from the LED filament lamp may be at least 70, preferably at least 75, and even more preferred 80.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
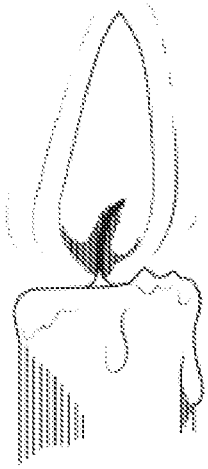
Fig. 1 Prior Art
FIG. 1 shows a candle according to the prior art.

FIG. 1 shows a candle according to the prior art. Candles, having an open flame, are able to generate light which is highly attractive and appealing. Light emitted from the open flame of a candle may, compared to LED and/or incandescent lamps, appear vivid, "warm", aesthetic and/or romantic. However, one of the major disadvantages of the use of candles is the risk of fire associated with an open flame. Therefore, it is an object of the present invention to try to explore the possibility of combing one or more of the respective advantages of candles and LED lighting devices.

Figure 2A:
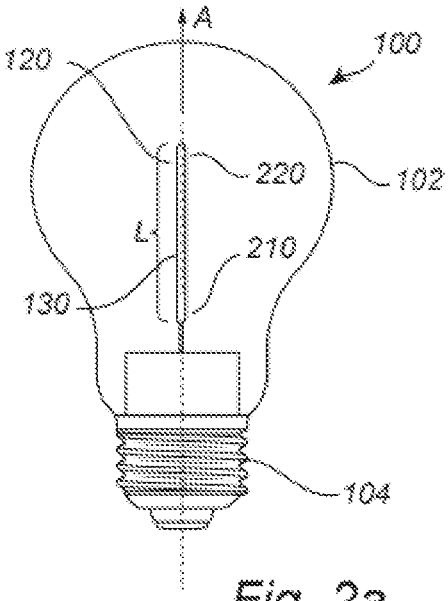
FIG. 2*a* shows a light emitting diode, LED, filament lamp according to an exemplifying embodiment of the present invention.
Figure 2B:
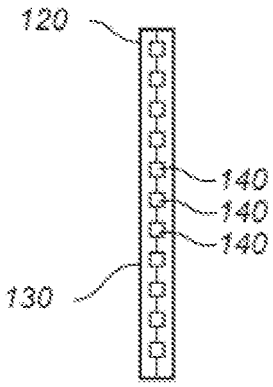
FIG. 2*b* shows a portion of a LED filament lamp according to an exemplifying embodiment of the present invention, FIGS. 3*a,b* show LED filaments of a LED filament lamp according to exemplifying embodiments of the present invention, FIGS. 4*a-c* schematically show the color temperature of the light emitted from at least one LED filament of a LED filament lamp according to exemplifying embodiments of the present invention.

FIG. 2*a* shows a light emitting diode, LED, filament lamp 100 according to an exemplifying embodiment of the present invention. The LED filament lamp 100 is exemplified as a bulb-shaped lamp extending along a longitudinal axis A of the LED filament lamp 100. The LED filament lamp 100 further comprises a transparent or diffusing (e.g. translucent) envelope 102, which preferably is made of glass. The LED filament lamp 100 further comprises a threaded cap 104 which is connected to the envelope 102. The LED filament lamp 100 further comprises a LED filament 120 extending over a length L along the longitudinal axis A. The LED filament 120, according to this example, extends along the longitudinal axis A of the LED filament lamp 100, and the LED filament 120 comprises a base portion 210 and a top portion 220. The LED filament 120, in its turn, comprises an array or "chain" of LEDs 140 which is arranged on the LED filament 120 as shown in FIG. 2*b*. For example, the array or "chain" of LEDs 140 may comprise a plurality of adjacently arranged LEDs 140 wherein a respective wiring is provided between each pair of LEDs 140. The plurality of LEDs 140 preferably comprises more than 5 LEDs, more preferably more than 8 LEDs, and even more preferred more than 10 LEDs. The plurality of LEDs 140 may be direct emitting LEDs which provide a color. The LEDs 140 are preferably blue light emitting diodes. The LEDs 140 may also be UV LEDs. A combination of LEDs 140, e.g. UV LEDs and blue light LEDs, may be used. Alternatively, a combination of colored LEDs 140, such as for example blue and red LEDs, may be used. The LEDs 140 may have a specific pattern, for example comprising alternating blue and red light LEDs. It will be appreciated that more blue light LEDs than red light LEDs may be used to achieve the desired color temperature to mimic candle light (e.g. in a LED array of blue-blue-red-blue-blue-red, etc.). There may also be an increase in red light LEDs as a function of the length of the LED filament 120 from its base portion to its top portion (e.g. in a LED array of blue-blue-blue-red-blue-blue-red-blue-red, etc.).

The LED filament 120 further comprises a substrate 130*a* of elongated shape for supporting the plurality of LEDs 140. For example, the plurality of LEDs 140 may be arranged, mounted and/or mechanically coupled to the substrate 130. The LED filament 120 further comprises an encapsulant (shown in FIG. 3*a*) which at least partially encloses the plurality of LEDs 140. The encapsulant may fully enclose the plurality of LEDs 140. Furthermore, the encapsulant may at least partly enclose the plurality of LEDs and the substrate 130.

The encapsulant comprises a luminescent material. For example, the luminescent material may comprise a fluorescent material, an inorganic phosphor, an organic phosphor, and/or quantum dots/rods. The encapsulant may furthermore, or alternatively, comprise a polymer material, for example a silicone.

Figure 3A:
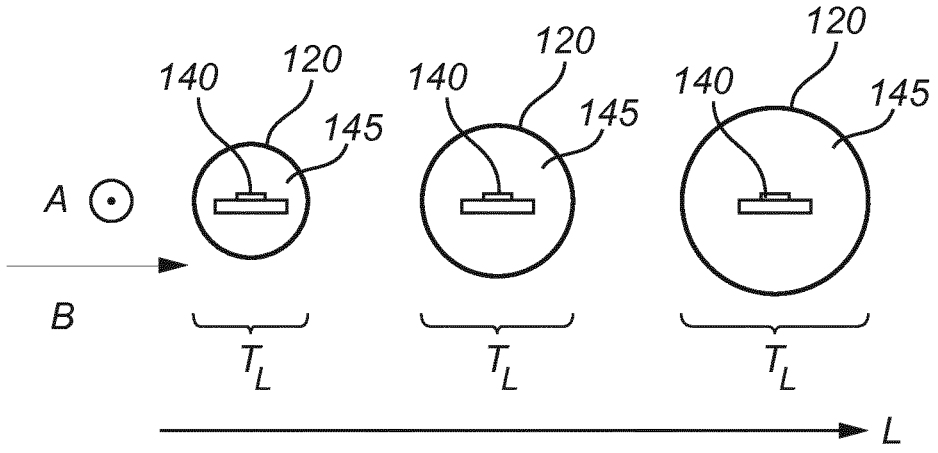
Figure 5:
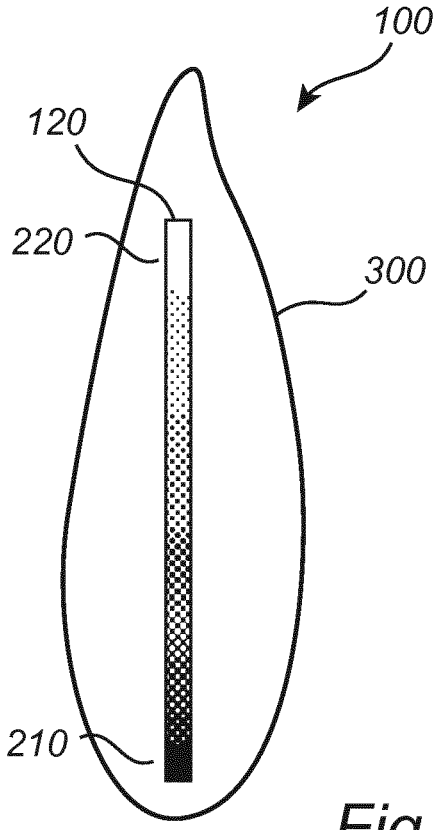
FIGS. 5-10 show examples of portions of LED filament lamps according to exemplifying embodiments of the present invention.

FIG. 3*a* schematically shows the cross-section of a LED filament 120 extending along the longitudinal axis A of the LED filament lamp 100, for example as shown in FIG. 2*a* and/or FIG. 5. The encapsulant 145 of the LED filament 120, which encapsulant 145 comprises the luminescent material, encloses the plurality of LEDs 140. Here, the encapsulant 145 may be exemplified as a glue which encloses or surrounds the plurality of LEDs 140. The thickness $T_L$ of the encapsulant increases over at least a portion of the length L of the filament 120 in a direction from a base portion 210 to a top portion 220 of the LED filament 120. In other words, the cross-section of the encapsulant 145, which comprises the luminescent material and which encloses the LEDs 140, increases along the longitudinal axis A. As a consequence, the color temperature $CT_L$ of the light emitted from the LED filament 120 is configured to decrease over the length of the LED filament 120 along the portion thereof in a direction from a base portion to a top portion of the LED filament 120.

Alternatively, the color temperature $CT_L$ of the light emitted from the LED filament 120 is configured to increase over the length of the LED filament 120 along the portion thereof in a direction from a base portion to a top portion of the LED filament 120.

Figure 3B:
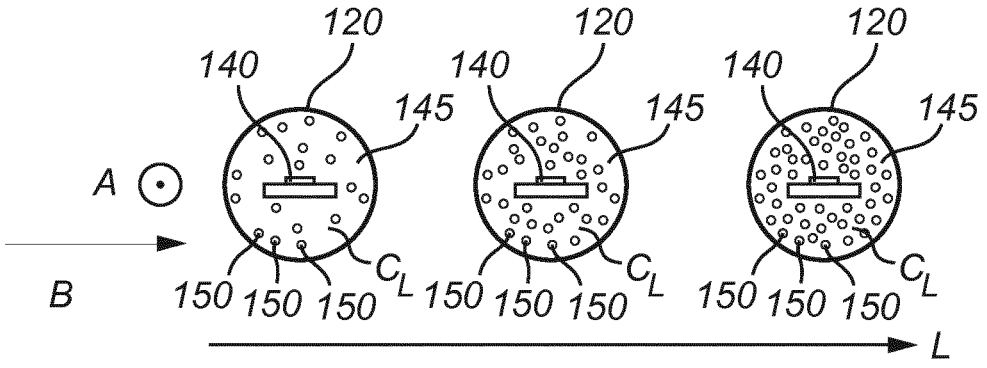

FIG. 3*b* schematically shows the cross-section of a LED filament 120 extending along the longitudinal axis A of the LED filament lamp 100, for example as shown in FIG. 2*a* and/or FIG. 5. The encapsulant 145 of the LED filament 120, which encapsulant 145 comprises the luminescent material 150, encloses the plurality of LEDs 140. Here, the luminescent material 150 of the encapsulant 145 may be exemplified as a material which is dispersed in the encapsulant 145 enclosing the plurality of LEDs 140. The concentration $C_L$ of the luminescent material 150 in the encapsulant 145 increases along the longitudinal axis A in a direction from a base portion to a top portion of the LED filament 120, which is disclosed by the indicated cross-sections of the encapsulant 145 comprising the luminescent material 150. Hence, the cross-sections of the encapsulant 145 disclose an increasing concentration $C_L$ of the luminescent material 150 in the encapsulant 145 of the LED filament 120*a* along the longitudinal axis A thereof. As a consequence, the color temperature $CT_L$ of the light emitted from the LED filament 120 is configured to decrease over the length of the LED filament 120 along the portion thereof, in a direction from a base portion to a top portion of the LED filament 120.

Figure 4A:
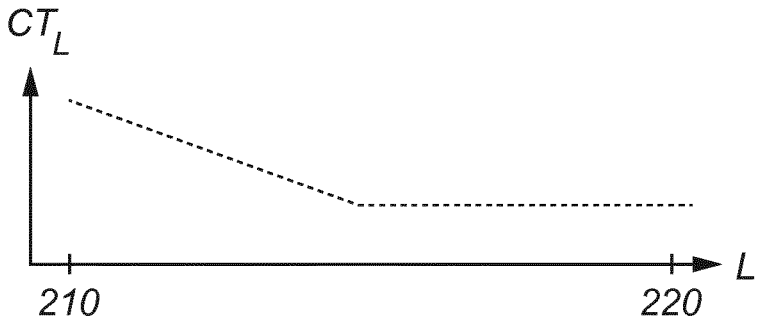
Figure 4B:
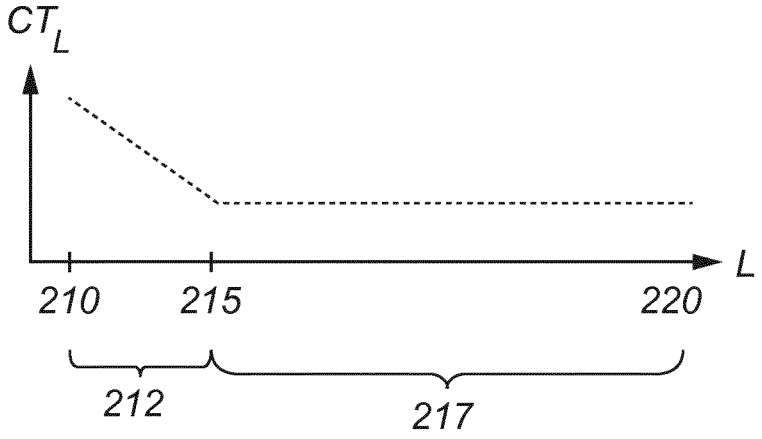
Figure 4C:
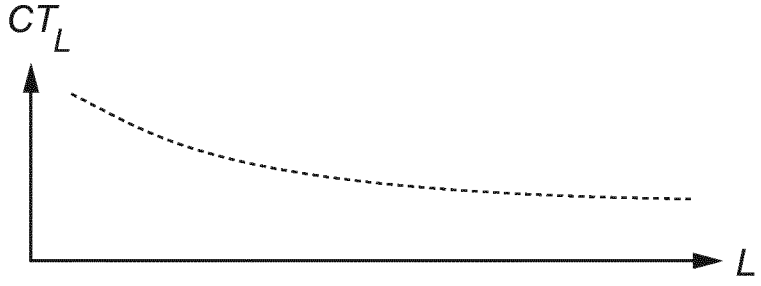

FIGS. 4*a-c* schematically show the color temperature $CT_L$ of the light emitted from the at least one filament of the LED filament lamp according to exemplifying embodiments of the present invention. Common to all FIGS. 4*a-c* is that the x-axis represents the length L of the at least one LED filament along its longitudinal axis A, in a direction from a base portion to a top portion of the LED filament 120, and the y-axis represents the color temperature $CT_L$ as a function of the length L.

In FIG. 4*a*, the color temperature $CT_L$ of the light emitted from the at least one LED filament decreases along its length L along the longitudinal axis A thereof. In other words, at a base portion 210 of the LED filament(s), the color temperature $CT_L$ is relatively high, whereas the color temperature $CT_L$ decreases along the length L of the LED filament(s) towards a top portion 220 of the LED filament(s). The decrease of the color temperature $CT_L$ as indicated in FIG. 4*a* is a result of an increase of the thickness of the luminescent material of the encapsulant and/or an increase of the concentration of the luminescent material in the encapsulant of the LED filament(s) of the LED filament lamp. It will be appreciated that even though the decrease of the color temperature $CT_L$ is exemplified as non-linear decrease, the decrease may also be linear by a suitable variation of the thickness and/or concentration of the luminescent material of the encapsulant of the LED filament(s).

In FIG. 4*b*, the color temperature $CT_L$ of the light emitted from the at least one LED filament decreases along a first section 212 of the LED filament(s), wherein the first section 212 is defined between a base portion 210 and an intermediate portion 215 of the at least one LED filament. The color temperature $CT_L$ thereafter remains constant along a second section 217 of the LED filament(s), wherein the second section 217 is defined between the intermediate portion 215 and a top portion 220 of the LED filament(s). The decrease of the color temperature $CT_L$ as indicated in the left-most portion of FIG. 4*b* is a result of an increase of the thickness of the encapsulant and/or an increase of the concentration of the luminescent material in the encapsulant, along the first section of the LED filament(s) of the LED filament lamp. The constant color temperature $CT_L$ as indicated in the right-most portion of FIG. 4*b* is a result of a constant formation or configuration of the thickness of the encapsulant and/or the concentration of the luminescent material in the encapsulant along the second section 217 of the LED filament(s). Hence, at a base portion 210 of the filament, the color temperature $CT_L$ of the light emitted from the LED filament(s) is relatively high, whereas the color temperature $CT_L$ decreases along the length L of the LED filament(s) towards a top portion 220 of the LED filament(s). It will be appreciated that even though the decrease of the color temperature $CT_L$ is exemplified as non-linear, the decrease may also be linear. Thereafter, along the second section 217 of the LED filament(s), the color temperature $CT_L$ remains substantially constant.

In FIG. 4*c*, the color temperature $CT_L$ of the light emitted from the at least one LED filament decreases according to a negative exponential curve as a function of the length L of the LED filament. Similarly to FIG. 4*b*, the first section of the LED filament is shorter than the second section of the LED filament.

Analogously, in the FIG. 4*a*-4*c* the color temperature of the LEDE filament may increase from the base portion to the top portion of the LED filament.

Regarding one or more of the embodiments of FIGS. 4*a-c*, the light emitted from the LED filament(s) may vary along the length of the LED filament(s) in the range of 5000 K to 1500 K, more preferably 4000 K to 1700 K, and most preferred 2700 K to 1900 K. The gradual increase or decrease of the color temperature of the LED filament(s) along its length may be at least 300 K. Furthermore, the color rendering index, CRI, of the light emitted from the LED filament lamp may be at least 70, preferably at least 75, and even more preferred 80.

FIGS. 5-10 show examples of portions of LED filament lamps according to exemplifying embodiments of the present invention. Common to all FIGS. 5-10 is that the portions and/or configurations of the LED filament lamps are arranged to mimic candle light. It will be appreciated that combinations of two or more of the shown embodiments are feasible.

FIG. 5 shows an exemplifying embodiment of a portion of a LED filament lamp 100. Analogously with the example of FIG. 2*a*, the LED filament lamp 100 comprises a LED filament 120 which has a base portion 210 to a top portion 220. The LED filament lamp 100 further comprises a diffusor element 300 which at least partially encloses the LED filament(s) 120 of the LED filament lamp 100. The diffusor element 300 is arranged to diffuse at least a portion of the light emitted from the LED filament(s) 120. The LED filament lamp 100 may further comprise a control unit (not shown) which is coupled to the LED filament(s) 120. The control unit may be configured to control the power supply to the LED filament(s) 120, and may be configured to individually control the operation of the plurality of LEDs of the LED filament(s) 120.

Figure 6:
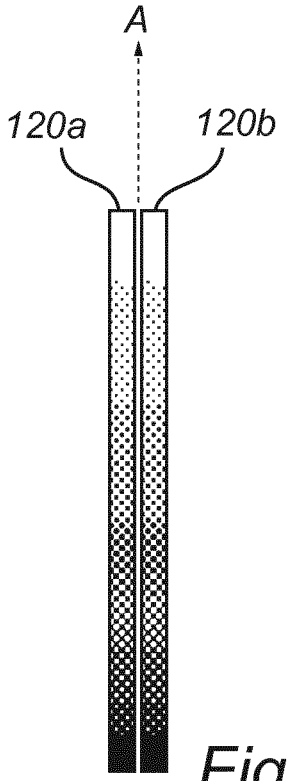

FIG. 6 shows an exemplifying embodiment of a portion of a LED filament lamp. The LED filament lamp comprises two LED filaments 120*a*, 120*b* which are arranged in parallel along the longitudinal axis A. It will be appreciated that the LED filament lamp may comprise even more LED filaments arranged in parallel. Furthermore, the term "parallel" may, alternatively, be construed as "essentially parallel". Hence, the two LED filaments 120*a*, 120*b* may be oriented in a mutually angled position, wherein the angle between the two LED filaments 120*a*, 120*b* may be 0-20°.

Figure 7:
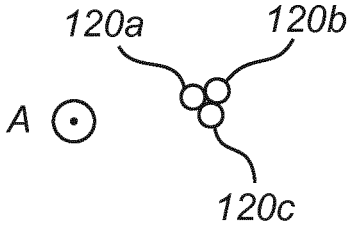

FIG. 7 shows yet another exemplifying embodiment of a portion of a LED filament lamp. The LED filament lamp comprises three LED filaments 120*a-c* which are arranged in parallel along the longitudinal axis A. Analogously with the example of FIG. 6, the three LED filaments 120*a-c* may be oriented in a mutually angled position, wherein the angle between the three LED filaments 120*a-c* may be 0-20°. The three LED filaments 120*a-c* are furthermore grouped such that in a cross-section, parallel to the transverse axis, B, each LED filament 120*a-c* is arranged on a respective corner of a triangle.

Figure 8:
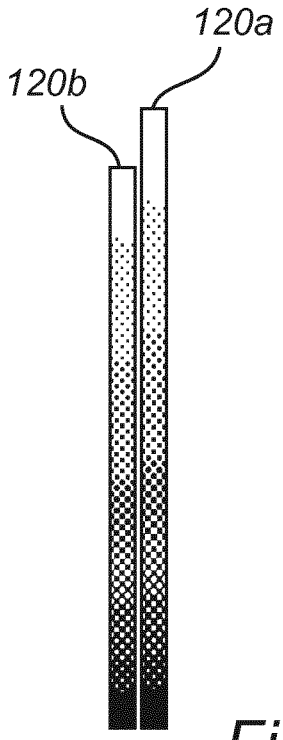

In FIG. 8, a portion of a LED filament lamp as exemplified comprises two LED filaments 120*a*, 120*b*. The lengths of the two LED filaments 120*a*, 120*b* differ from each other in that the LED filament 120*a* is longer than the LED filament 120*b*. Although FIG. 8 show two LED filaments 120*a*, 120*b*, it should be noted that the LED filament lamp may comprise even more LED filaments, of which at least two differ in length.

Figure 9:
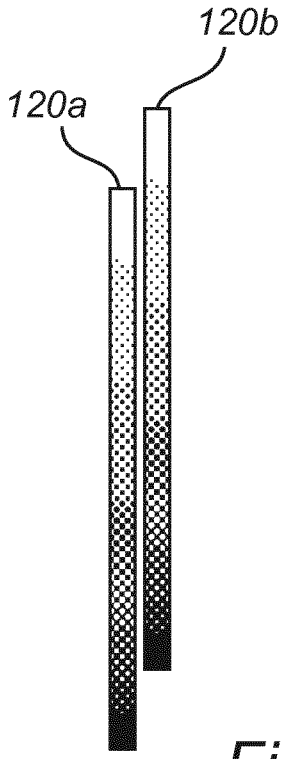

FIG. 9 shows yet another exemplifying embodiment of a portion of a LED filament lamp 100. The LED filament lamp 100 comprises two LED filaments 120*a*, 120*b*. The LED filaments 120*a*, 120*b* are shifted with respect to each other along the longitudinal axis A.

Figure 10:
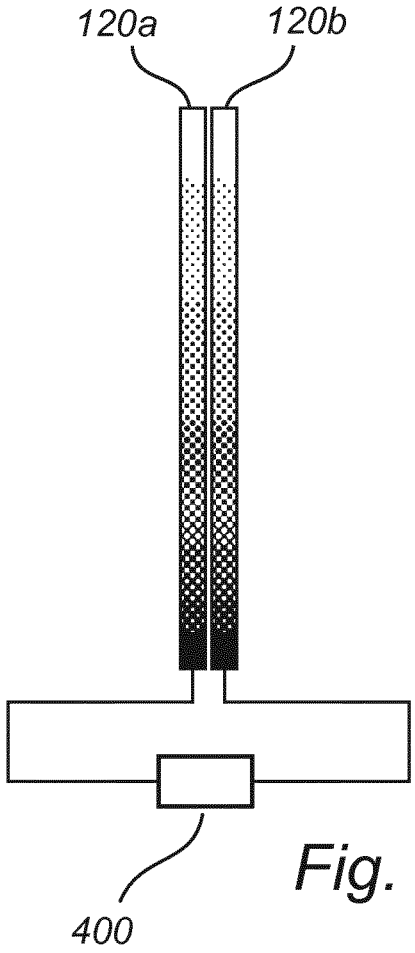

FIG. 10 shows yet another exemplifying embodiment of portion of a LED filament lamp. The LED filament lamp further comprises a schematically indicated control unit 400 which is coupled to a pair of LED filaments 120*a*, 120*b*. The control unit 400 is configured to control the power supply to the pair of LED filaments 120*a*, 120*b*.

Figure 11:
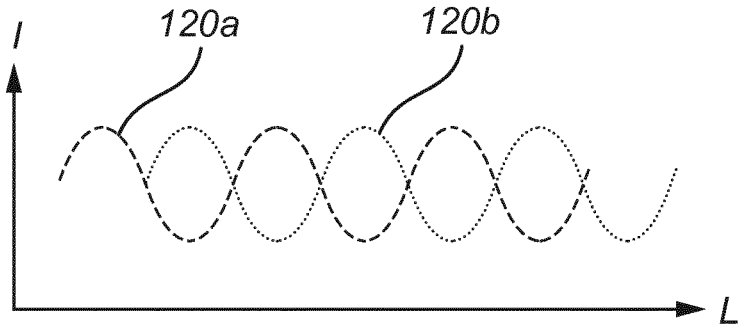
FIG. 11 shows a power supply to at least one LED filament of a LED filament lamp.

FIG. 11 shows a power supply I to at least one LED filament of a LED filament lamp, e.g. to the pair of LED filaments 120*a*, 120*b* as shown in FIG. 10. The control unit is configured to control the power supply I of the two LED filaments 120*a*, 120*b* individually as a function of time and/or length of the LED filament L. As exemplified in FIG. 11, the control unit may control a phase shift of 180° of the power supply I between the LED filaments 120*a*, 120*b*. The obtained effect is that different light effects (i.e. color temperature effects) can be achieved which mimic candle light.

The person skilled in the art realizes that the present invention by no means is limited to the preferred embodiments described above. On the contrary, many modifications and variations are possible within the scope of the appended claims. For example, one or more of the LED filament(s) 120, etc., may have different shapes, dimensions and/or sizes than those depicted/described.

The invention claimed is:

1. A light emitting diode, LED, filament lamp, comprising at least one LED filament extending over a length, L, along a longitudinal axis, A, wherein the LED filament comprises an array of a plurality of light emitting diodes, LEDs, extending along the longitudinal axis, and an encapsulant at least partially enclosing the plurality of LEDs, wherein the encapsulant comprises a luminescent material, and wherein at least one of the thickness, $T_L$, of the encapsulant along a transverse axis, B, perpendicular to the longitudinal axis, and the concentration, $C_L$, of the luminescent material in the encapsulant, increases or decreases over at least a portion of the length of the at least one LED filament along the longitudinal axis, whereby the color temperature, $CT_L$, of the light emitted from the at least one LED filament decreases or increases respectively over the length of the at least one LED filament at least along the portion thereof, and wherein at least one of the thickness of the encapsulant and the concentration of the luminescent material in the encapsulant increases at least along a portion of the at least one LED filament from a base portion to a top portion thereof, whereby the color temperature of the light emitted from the at least one LED filament decreases from the base portion to the top portion at least along the portion of the at least one LED filament.

2. The LED filament lamp according to claim 1, wherein at least one of the thickness of the encapsulant and the concentration of the luminescent material in the encapsulant increases non-linearly.

3. The LED filament lamp according to claim 1, wherein a first section of the at least one LED filament is defined between a base portion and an intermediate portion of the at least one LED filament, and a second section of the at least one filament is defined between the intermediate portion and a top portion of the at least one LED filament, wherein at least one of the thickness of the encapsulant and the concentration of the luminescent material in the encapsulant increases along the first section and remains constant along the second section, whereby the color temperature of the light emitted from the at least one LED filament decreases along the first section and remains constant along the second section.

4. The LED filament lamp according to claim 3, wherein the first section is shorter than the second section.

5. The LED filament lamp according to claim 1, further comprising a diffusor element at least partially enclosing the at least one LED filament and arranged to diffuse at least a portion of the light emitted from the at least one LED filament.

6. The LED filament lamp according to claim 1, further comprising a control unit coupled to the at least one LED filament and configured to control the power supply to the at least one LED filament.

7. The LED filament lamp according to claim 6, wherein the control unit is configured to individually control an operation of each LED of the plurality of LEDs.

8. The LED filament lamp according to claim 6, comprising at least two LED filaments, wherein the control unit is configured to individually control the power supply of the at least two LED filaments and to individually control the operation of each LED of the plurality of LEDs of each LED filament.

9. The LED filament lamp according to claim 1, wherein at least one LED filament comprises a combination of LEDs emitting light in at least two different colors.

10. The LED filament lamp according to claim 1, comprising at least two LED filaments arranged in parallel along the longitudinal axis.

11. The LED filament lamp according to claim 1, comprising at least two LED filaments, wherein the lengths of at least two of the at least two LED filaments differ from each other.

12. The LED filament lamp according to claim 1, comprising at least two LED filaments, wherein at least two of the at least two LED filaments are shifted with respect to each other along the longitudinal axis.

13. The LED filament lamp according to claim 1, comprising at least two LED filaments, whereby the color temperature, $CT_{L1}$, of the light emitted from at least one first LED filament differs, at least along a portion thereof along the longitudinal axis, from the color temperature, $CT_{L2}$, of the light emitted from at least one second LED filament.

14. The LED filament lamp according to claim 1, wherein the color temperature of the light emitted from the at least one LED filament varies along the length of the at least one LED filament in the range of 5000 K to 1500 K, more preferably 4000 K to 1700 K, and most preferred 2700 K to 1900 K.

* * * * *